United States Patent [19]

Georget

[11] 4,077,316

[45] Mar. 7, 1978

[54] SUGAR CANE MILL

[75] Inventor: Jean Pierre Georget, Denain, France

[73] Assignee: Fives-Cail Babcock, Paris, France

[21] Appl. No.: 709,310

[22] Filed: Jul. 28, 1976

[30] Foreign Application Priority Data

Jul. 29, 1975 France ..... 75.23567

[51] Int. Cl.[2] ..... B30B 3/04

[52] U.S. Cl. ..... 100/163 R; 100/169

[58] Field of Search ..... 100/162 R, 163 R, 165, 100/169, 170, 171; 29/126

[56] References Cited

U.S. PATENT DOCUMENTS

| | | | |
|---|---|---|---|
| 2,563,690 | 8/1951 | Nalon | 100/170 X |
| 2,832,280 | 4/1958 | Hold | 100/170 |
| 3,329,084 | 7/1967 | Cooman | 100/165 |

*Primary Examiner*—Edward J. McCarthy

*Attorney, Agent, or Firm*—Kurt Kelman

[57] ABSTRACT

A sugar cane mill comprises two lower cylinders mounted on respective support beds and an upper cylinder carried by two bearing connected to respective cover members pivotally mounted on a respective support bed. Elastically deformable blocks connect each bearing to a respective cover member to permit movements of the upper cylinder with respect to the cover members in a direction approximately perpendicular to a plane defined by the axis of the upper cylinder and the resultant of the pressure forces during normal operation of the mill. The blocks extend on either side of the plane.

9 Claims, 3 Drawing Figures

SUGAR CANE MILL

Figure 1:
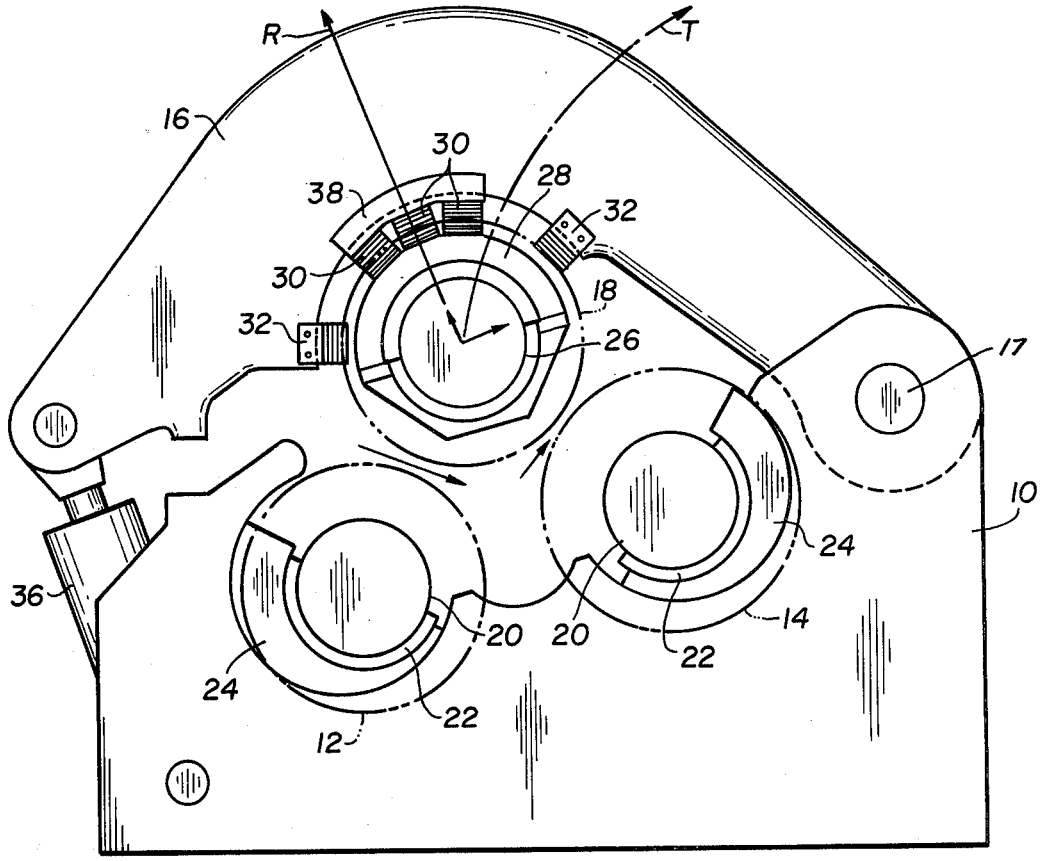

The present invention relates to improvements in a sugar cane mill which comprises two support beds, two lower cylinders, each lower cylinder being mounted on a respective ones of the support beds, two cover members, each cover member being pivotally mounted on a respective one of the support beds, two bearings, and an upper cylinder having an axis and carried by the two bearings.

In a mill of this type, the relation between the inlet opening and the outlet opening remains substantially constant regardless of the throughput and it is accordingly the same for pressures at the inlet and the outlet. However, when the throughput varies considerably, the layer of fibrous material to be crushed is not uniform and the constancy of the relation between the inlet and outlet openings does not suffice to maintain the pressures at the inlet and outlet constant. More particular, when the entering layer of fibrous material momentarily reaches increased thickness, the upper cylinder will be lifted and moved, farther apart from the lower cylinders along a circular tranjectory centered about the pivoting axis of the cover members, which is translated into a reduced pressure, at a lowered efficiency of the mill.

In conventional mills, in which the milling cylinders are moved apart in a rectilinear path, it has been proposed to overcome this disadvantage by permitting the upper cylinder to be freely displaced perpendicularly in the direction of the push exercized by the jacks.

In practice, it has not been possible to find a structural solution of the problem in mills of the indicated type because it does not take into account forces, other than the reactions of the lower cylinders, which are applied against the upper cylinder and, particularly, reactions between the pinions and the fibrous material to be crushed. Generally, it has not been possible with the known structures to maintain the upper milling cylinder in stable equilibrium because it came to abut against a fixed part of the support and this produced the disadvantage sought to be avoided.

It is the primary object of this invention to overcome this disadvantage by providing, between the upper cylinder and the cover members, a connection permitting the cylinder to move with respect to the cover members along a limited distance sufficient to avoid unduly influencing the cone extraction by variations in the momentary throughput. At the same time, the connection is rigid enough, under normal operating conditions, to maintain a substantially constant relation between the inlet and outlet openings of the mill.

With this and other objects in view, the invention provides at least one elastically deformable block connecting each bearing to a respective one of the cover members, the block or blocks being arranged to permit movements of the upper cylinder with respect to the cover members in a direction approximately perpendicular with the plane defined by the axis of the upper cylinder and the resultant of the pressure forces during normal operation of the mill, and the block or blocks extending to either side of the plane.

Figure 2:
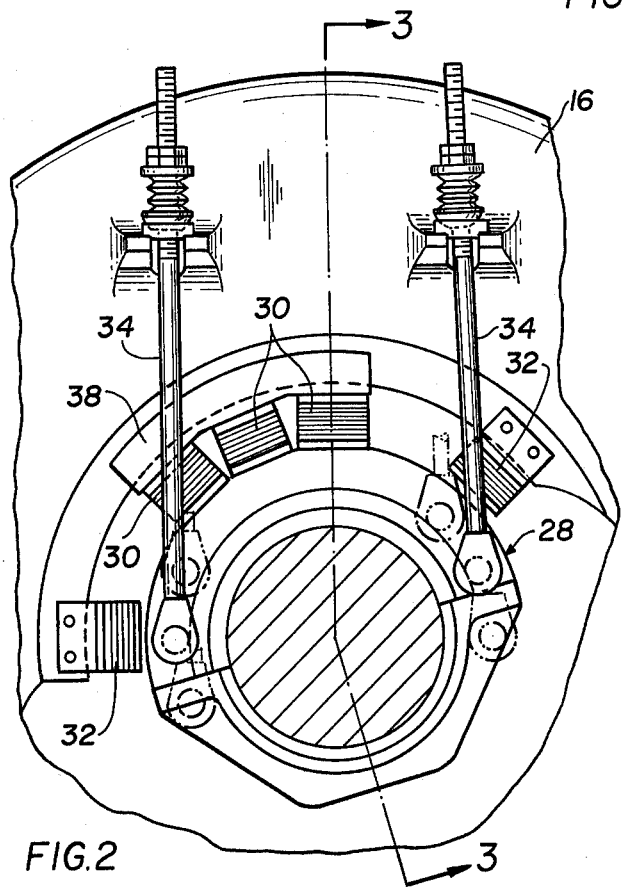
Figure 3:
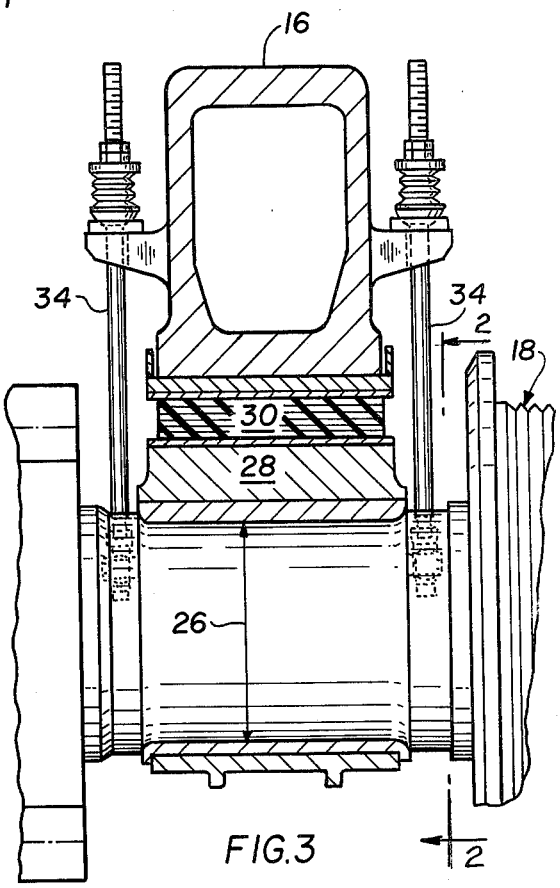

The above and other objects, advantages and features of the present invention will become more apparent from the following detailed description of a now preferred embodiment thereof, taken in conjunction with the accompanying drawing wherein FIG. 1 is a side elevational view of a sugar cane mill according to this invention;

FIG. 2 shows an embodiment of the mounting of the elastically deformable blocks, partly in along line 2—2 of FIG. 3, on an enlarged scale; and FIG. 3 is a section along line 3—3 of FIG. 2.

Referring now to the drawing, the illustrated sugar cane mill comprises two support beds 10 and two lower cylinders, inlet cylinder 12 and outlet cylinder 14, each mounted on a respective one of the support beds. Two cover members 16 are respectively pivotally mounted on a respective support bed 10 about pivot 17 and two bearings 28 carry upper cylinder 18. Lower inlet cylinder 12 and lower outlet cylinder 14 define with upper cylinder 18 an inlet and an outlet opening, respectively. Sugar cane (not shown) is fed to the mill and passed from the inlet to the outlet opening between the cylinders, as shown by arrows.

The ends of lower cylinders 12 and 14 have trunnions 20 journaled in bearings 22 which are mounted on the support beds by means of crescent-shaped wedges 24. These wedges permit the position of the lower cylinders to be adjusted with respect to the support beds. The ends of upper cylinder 18 also carries trunnions 26 mounted on bearing 28 which are connected to the respective cover members by means of elastically deformable blocks 30.

In the illustrated embodiment, three blocks are provided for each bearing. These blocks may be made of an elastic material permitting deformation by compression forces less than by shearing forces. They may be of natural of synthetic rubber and, in the illustrated embodiment, they are constituted by an assembly of alternating elastic and metallic blades bonded together into a laminated unit. The elastically deformable blocks are so arranged as to permit movements of the upper cylinder with respect to the cover members in a direction approximately perpendicular to the plane defined by the axis of upper cylinder 18 and resultant R of the pressure forces during normal operation of the mill. Blocks 30 extend to either side of this plane.

In this illustrated embodiment, cover members 16 have a cylindrical surface concentric with upper cylinder 18 and similarly shaped support 38 for blocks 30 is mounted for adjustment of the angular position thereof with respect to the cover member by displacement of the support along the concentric cylinder surface thereof. The three blocks are disposed symmetrically with respect to the plane defining the upper cylinder axis and resultant R of the pressure forces normally generated during the operation of the mill, i.e. when the layer of sugarcane or bagasse has a substantially constant thickness and composition. This adjustable support for the elastic blocks makes it possible to adapt the structure to all mills of the battery of mills, adjustment of the position of the elastic blocks being effectuated at the time of assembly.

As shown, the medium axis of the assembly of blocks 30 is situated at the same side as inlet cylinder 12 with respect to a vertial plane passing through the axis of upper cylinder 18.

The elastic blocks may be, for example, paralleliped blocks of natural or synthetic rubber on whose upper and lower faces are affixed, for example by adhesive, platelets which themselves are affixed, for example by screws, to bearings 28 and cover membrs 16, respectively. In whatever shape or construction, the blocks have a sufficient resistance to compression to transmit forces to which the upper cylinder is subjected to the cover members. Their deformation in a radial direction is much weaker, under equal pressure, than in a tangential direction.

While the elastially deformable block or blocks may be affixed directly to the cover members, they are shown carried by adjustable support 38 which may be fixed in any desired angular position. As shown and in case the blocks or their mountings on the cover members and upper cylinder bearings are not capable of sustaining traction forces, bearings 28 are connected by cover members 16 by a pendulum suspension which permits free displacement of the upper cylinder and supports it when the mill is empty. This suspension comprises tie rods 34 connecting each bearing to the respective cover member, respective ends of the tie rods being linked to cover members 16 and bearings 28 by ball-and-socket joints permitting pendulum movements of the bearings in all directions. The tie rods serve not only to support the upper cylinder when the mill is not charged but also enable the elastic blocks to be angularly adjusted.

Instead of disposing elastic blocks 30 along cylindrical surfaces, they could be aligned in a plane approximately perpendicular to the plane containing the axis of upper cylinder 18 and resultant R. Also, a single elastic block could be used, with plane or cylindrical faces, for each cover member.

In the illustrated embodiment, elastic stops 32 are positioned on either side of blocks 30 between the associated cover members and bearings to limit the movements of upper cylinder 18 with respect to cover members 16 transversely in the direction of the resultant of the normal pressing forces. The stops may be constituted by rubber, for example, and are spaced from the bearings during normal operations, as shown in the drawing. The bearings come into contact with the stops only when the mill is abnormally charged, particularly when only the inlet or outlet of the mill are charged while the stops do not interfere with the normal operation.

Two jacks 36 press the upper cylinder against the lower cylinders, the cylinders of the jacks being linked to the support beds and the piston rods thereof being linked to the free ends of the cover members opposite their pivoted ends.

In operation, when the thickness of the layer of sugar cane between inlet cylinder 12 and upper cylinder 18 suddenly increases, the latter recedes under the increased pressure. This movement is made possible by the elastically deformable blocks 30 and, combined with the movement of the cover members, permits the inlet pressure to be returned to normal without substantially modifying the pressure at the outlet. After this normalization and return of the layer thickness to normal, the upper cylinder resumes its normal position. The same happens when the sugar cane is jammed at the outlet and thus increases in thickness. However, for the same pressure variation, the displacement of the upper cylinder is much smaller than when the extra layer thickness appears at the inlet, due to the disposition and particular orientation of the elastic blocks, which is justified by the fact that the increases of the layer thickness are much less at the outlet than at the inlet.

As will be appreciated, the elastic blocks serve not only to compensate for variations in the thickness of the material being crushed between the cylinders but also replace conventionally used universal joints permitting the upper cylinder to be inclined with respect to the lower cylinders when the layer thickness is not uniform along the width of the mill, i.e. the length of the cylinders.

What is claimed is:

1. A sugar cane mill comprising the combination of 1. two support beds,
2. two lower cylinders, each lower cylinder being mounted on a respective one of the support beds,
3. two cover members, each cover member being pivotally mounted on a respective one of the support beds,
4. two bearings,
5. an upper cylinder having an axis and carried by the two bearings, and
6. at least one elastically deformable block connecting each bearing to a respective one of the cover members, the block or blocks being arranged to permit movements of the upper cylinder with respect to the cover members in a direction approximately perpendicular to the plane defined by the axis of the upper cylinder and the resultant of the pressure forces during normal operation of the mill, and the block or blocks extending on either side of the plane.

2. The sugar cane mill of claim 1, wherein the cover members have a cylindrical surface concentric with the upper cylinder and further comprising a support for the block or blocks, the support being mounted for adjustment of the angular position thereof with respect to the respective cover member by displacement of the support along the concentric cylindrical surface of the cover member.

3. The sugar cane mill of claim 1, wherein a plurality of the blocks are arranged in one plane.

4. The sugar cane mill of claim 1, wherein a plurality of the blocks are disposed along cylindrical surfaces.

5. The sugar cane mill of claim 1, wherein the lower cylinders include an inlet cylinder, the median axis of the block or assembly of blocks being situated at the same side as the inlet cylinder with respect to a vertical plane passing through the axis of the upper cylinder.

6. The sugar cane mill of claim 1, wherein the elastically deformable block or blocks are deformed by compression forces less than by shearing forces.

7. The sugar cane mill of claim 1, wherein each elastically deformable block is constituted by an assembly of alternating elastic and metallic blades.

8. The sugar cane mill of claim 1, further comprising elastic stops positioned on either side of the block or blocks between the associated cover members and bearings to limit the movements of the upper cylinder with respect to the cover members transversely in the direction of the normal resultant of the pressing forces, the stops being arranged not to interfere with the normal operation.

9. The sugar cane mill of claim 1, further comprising tie rods connecting each of the bearings to the respective cover member, respective ends of the tie rods being linked to the cover members and bearings by means for ball-and-socket joints permitting pendulum movements of the bearings in all directions.

* * * * *